US011619473B2

(12) United States Patent
Rath

(10) Patent No.: US 11,619,473 B2
(45) Date of Patent: Apr. 4, 2023

(54) COMMAND MIXING FOR ROLL STABILIZED GUIDANCE KIT ON GYROSCOPICALLY STABILIZED PROJECTILE

(71) Applicant: BAE SYSTEMS Information and Electronic Systems Integration Inc., Nashua, NH (US)

(72) Inventor: Curtis B. Rath, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/145,455

(22) Filed: Jan. 11, 2021

(65) Prior Publication Data

US 2022/0221258 A1 Jul. 14, 2022

(51) Int. Cl.
*F42B 10/64* (2006.01)
*F42B 10/26* (2006.01)

(52) U.S. Cl.
CPC ..... *F42B 10/26* (2013.01); *F42B 10/64* (2013.01)

(58) Field of Classification Search
CPC ..... F42B 10/64
See application file for complete search history.

(56) References Cited

U.S. PATENT DOCUMENTS 5,088,658 A 2/1992 Forsmo
9,702,674 B2 7/2017 Fairfax et al.
11,150,062 B1 * 10/2021 Jankowski ..... F42B 10/64
2008/0029641 A1 * 2/2008 Carlson ..... F42B 10/64 244/3.24
2011/0180654 A1 7/2011 Thiesen et al.
2014/0061365 A1 * 3/2014 Roy ..... F42B 10/64 244/3.24
2019/0257628 A1 * 8/2019 Roy ..... F42B 10/64
2022/0221258 A1 7/2022 Rath

OTHER PUBLICATIONS

Fresconi et al., Optimal Parameters for Maneuverability of Affordable Precision Munitions, Army Research Laboratory, 2011.
https://en.wikipedia.org/wiki/V-tail, accessed May 26, 2020.
International Search Report, PCT/US22/11826, dated Sep. 28, 2022, 9 pages.

* cited by examiner

*Primary Examiner* — J. Woodrow Eldred
(74) *Attorney, Agent, or Firm* — Gary McFaline; KPIP Law, PLLC

(57) ABSTRACT

The system and method of mixing pitch and roll commands from a flight control computer to produce fin deflections applied to as few as two fins to simultaneously produce both a rolling moment and a pitching moment. The system may be mechanical or digital where actuators can be linear or rotary, digital or analog. Deflections of the fins are generated which produce pitch and roll moments where addition of pitch and roll commands determines deflection commands to be sent to a first fin and subtraction of pitch and roll commands determines deflection commands to be sent to a second fin.

9 Claims, 4 Drawing Sheets
(2 of 4 Drawing Sheet(s) Filed in Color)

COMMAND MIXING FOR ROLL STABILIZED GUIDANCE KIT ON GYROSCOPICALLY STABILIZED PROJECTILE

FIELD OF THE DISCLOSURE

The present disclosure relates to guided projectiles and more particularly roll controlled guidance of a guided projectile utilizing command mixing.

BACKGROUND OF THE DISCLOSURE

Precision guided munitions refers to various types of rockets, missiles, rounds and other projectiles that guide a munition to a target. Gyroscopically stabilized munitions can be guided by a guidance kit attached at the front of the projectile. Typically, the guidance kit is de-spun after launch and then oriented to allow pitch fins to help rotate the projectile to a desired direction. De-spinning the guidance kit and then adjusting or maintaining a desired roll orientation requires significant sized canards (or fins). These canards (or fins) reduce the gyroscopic stability of the projectile and also tend to destabilize the projectile. Typically four canards are used but other numbers of canards are possible.

Other guidance systems in use include skid-to-turn, bank-to-turn, and rolling airframe. Skid-to-turn and bank-to-turn are typically applied to fin-stabilized projectiles; but can also be applied to gyro-stabilized projectiles if a bearing is fitted to decouple the guidance kit from the spinning main body in order to allow the canards or fins in either of these types of guidance system to be oriented in roll as needed. Fin-stabilized projectiles do not usually spin. Many missiles are fin stabilized as well as a few artillery munitions. Non-spinning, fin-stabilized projectiles are easier to control and guide, but tend to have higher drag. The increased drag can affect the distance achieved as well as operational performance. Fins aft of the center of gravity of a projectile are more aerodynamically stable, but are more difficult to fit in a design as they usually take space away from propulsion or must fit within a cannon bore for a gun launched projectile. Canards forward of the center of gravity avoid both these packaging problems, but are aerodynamically destabilizing.

Skid-to-turn guidance systems need little or no roll control, as the roll orientation is not changed in the guidance action. Absent spinning, the skid-to-turn scheme commands canards or fins to achieve moments used to point the projectile in a desired direction of pitch and yaw, but not roll. In fact, the directions need not even be referenced to pitch and yaw, but merely considered perpendiculars to the two sets of generating control fins. The projectile is usually flown with a roll orientation making the canards or fins resemble the letter X compared to the lift direction. Generally three, or more commonly, four canards or fins of the same size are used for skid-to-turn guidance. If aft fins are used, drag will be higher. If forward canards are used, stability will be lower. And since the canards are likely to be all the same size, only reducing their size and control effectiveness can reduce their de-stabilizing effect.

Bank-to-turn guidance systems use roll canards or fins to roll the projectile to a desired angle for the action of the pitch canards or fins. Then the pitch canards generate pitching moment to turn the projectile to a desired direction. In bank-to-turn, roll control canards or fins are commanded and act separately from the pitch canards or fins, since they do not produce any pitching moment. Yet, at launch and shortly after launch but before the kit is de-spun, the roll canards contribute to moments that reduce gyroscopic stability and they produce drag. Both of these detriments occur and have no direct contribution to steering the projectile toward a target.

Rolling airframe systems can also be used with a fin-stabilized system, provided it is also spinning, and is not roll controlled. In the rolling airframe example, the airframe continually rotates, and controls are applied periodically to generate pitch at the times when it is directed to do so as desired to guide the projectile. The method can be used with as few as two canards or fins. One disadvantage is a lower average control power for the size of the control surfaces as the time in a desirable orientation is only a fraction of the time for each rotation. In general, this system has higher drag, less precise control, and less capacity to steer toward a target.

Roll-brake and pitch control systems consist of a main body and a guidance kit attached on the nose. The guidance kit is equipped with pitch canards, two generally. The pitch canards may or may not be controlled; i.e. might be at a fixed angle or variable control deflection angle. The guidance kit, decoupled by a bearing from the main body of the projectile, tends to spin due to bearing friction yet is retarded from full spin by the roll damping aerodynamic effects of the pitch canards. The pitch canards could be set at a differential angle (only a small angle is needed) which could act to oppose bearing friction, to rotate the kit in the opposite direction. The system generally also includes a brake which would, on command, apply torque to the kit to accelerate its rotation with respect to the main body. Application and release of the brake can be modulated in time to place and keep the pitch canard direction aligned as desired. This method typically gives imprecise control over the roll angle direction, hence imprecise control of the pitching moment direction. One advantage is simplicity, as the on-off control of a brake is what is required of the mechanism.

Wherefore it is an object of the present disclosure to overcome the above-mentioned shortcomings and drawbacks associated with conventional guidance kits.

SUMMARY OF THE DISCLOSURE

One aspect of the present disclosure is system for command mixing of a controlled guidance kit for a projectile, comprising: a first and a second canard, wherein each canard is connected to a respective first and second control horn; the first and second control horns being located on opposite ends of a drive bar; a link shaft being connected via a first end to the drive bar and via a second end to a gimbal; and a first actuator acting on the gimbal via a third control horn and a second actuator acting on the drive bar; as the first actuator extends or retracts, the link shaft tilts to raise the drive bar with both ends of the drive bar moving in the same direction so the first and second control horns turn the first and second canards, respectively, in the same direction to generate an aerodynamic pitching moment; as the second actuator extends or retracts per a roll command it pushes or pulls on the end of the third control horn causing it to rotate the link shaft, consequently the link shaft rotation turns the drive bar perpendicular to a drive bar axis such that one end moves up and the other moves down, such that the drive bar ends connected to the first and second control horns move in opposite directions causing the first and second canards to deflect in opposite directions to generate an aerodynamic rolling moment.

One embodiment of the system for mechanical command mixing is wherein a ratio of canard deflection to a first actuator extension is set and can be altered by a length from a gimbal axis to an actuator connection.

Another embodiment of the system for mechanical command mixing is wherein a ratio of canard deflection to a second actuator extension is set and can be altered by a length from an actuator connection to the link shaft to the link shaft axis.

In certain embodiments of the system for mechanical command mixing, the gimbal allows the link shaft to simultaneously tilt for pitch control and rotate for roll control. In some cases, given pitch and roll commands, deflections of the first and the second canards are generated which produce pitch and roll moments where addition of pitch and roll commands determines deflection commands to be sent to the first canard and subtraction of pitch and roll commands determines deflection commands to be sent to the second canard.

Yet another embodiment of the system for mechanical command mixing is wherein a mixing ratio is varied to accommodate or compensate for different pitch and roll responses. In some cases, the projectile is gyroscopically stabilized. In certain embodiments, the first actuator or second actuator is a digital servo or an analog servo and the first actuator or second actuator is a linear servo.

Another aspect of the present disclosure is a guidance kit, comprising: a first canard and a second canard configured for a projectile, wherein each canard is connected to a respective first and second control horn; a first actuator acting on the first control horn; and a second actuator acting on the second control horn; the first and second actuators are directed by digitally mixed commands from a flight control computer to produce differing canard deflections wherein when the first and second canards deflect in the same direction a pitching moment is generated and when the canards deflect in opposite directions a rolling moment is generated.

One embodiment of the system for mechanical command mixing is wherein data from a flight control computer is communicated through a cable or wireless. In some cases, the system further comprises a travel or position sensor for providing feedback to the flight control computer.

Another embodiment of the system for mechanical command mixing is wherein given pitch and roll commands, deflections of the first and the second canards are generated which produce pitch and roll moments where addition of pitch and roll commands determines deflection commands to be sent to the first canard and subtraction of pitch and roll commands determines deflection commands to be sent to the second canard. In some cases, a mixing ratio is varied to accommodate or compensate for different pitch and roll responses.

In certain embodiments, the projectile is gyroscopically stabilized. In some embodiments, the first actuator or second actuator is a digital servo or an analog servo and first actuator or second actuator is a linear servo.

Yet another aspect of the present disclosure is a method for command mixing of a roll controlled guidance kit on a projectile, comprising: providing a first and a second canard on a projectile, wherein the first and second canards are acted on by a first and a second actuator, respectively; receiving mixing commands from a flight control computer on the projectile; producing differing canard deflections wherein when the first and second canards deflect in the same direction a pitching moment is generated and when the canards deflect in opposite directions a rolling moment is generated; and sensing a position and a velocity of the projectile for suppling the flight control computer with data for guiding the projectile.

One embodiment of the method for command mixing is wherein a mixing ratio is varied to accommodate or compensate for different pitch and roll responses.

Another embodiment of the method for command mixing is wherein the canards are mechanically controlled.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure. The patent or application file contains at least one drawing executed in color. Copies of this patent or patent application publication with color drawing(s) will be provided by the Office upon request and payment of the necessary fee.

DETAILED DESCRIPTION OF THE DISCLOSURE

Figure 1:
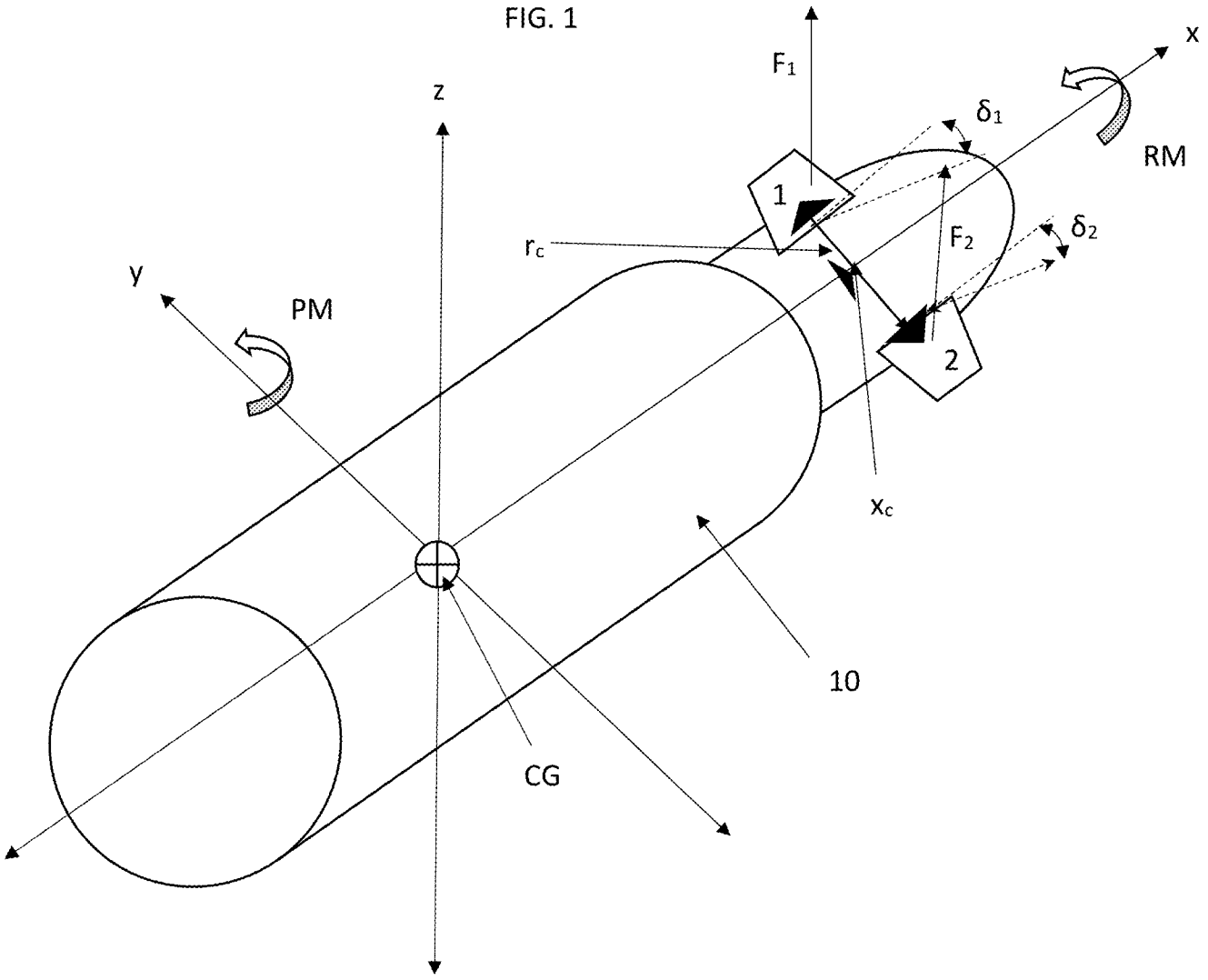
FIG. 1 shows one embodiment of a guidance kit on a projectile according to the principles of the present disclosure.

It is understood that precision guidance projectiles have significant gyroscopic stability challenges. One embodiment is wherein a projectile is a weapon, a munition, a ballistic, a bullet, a round, or a guided weapon. In one embodiment of the present disclosure, a potential for improvement in roll stabilization for precision guided projectiles uses command mixing. In certain embodiments, the use of command mixing provides a gain of about one percent or more improvement in gyroscopic stability. In some cases the use of command mixing allows for the elimination of the roll canards and thus adds about five percent improvement in the gyroscopic stability. Eliminating the roll canards can also reduce the drag on the guided projectile. In certain embodiments, eliminating the roll canards, allows the area of the pitch canard to be increased in order to gain more maneuverability without dipping below the desired stability for the guided projectile. The guidance kit in one example is a section that can be coupled to the projectile.

With command mixing according to one embodiment, two canards can be used where typically four were used. This reduction can eliminate the need for the roll canards and their detrimental effect on gyroscopic stability. This also reduces parts count and lowers weight which may lead to other advantages of cost and performance. Since extremes of pitch and roll commands seldom occur simultaneously, saturation of the mixed commands should also be seldom, and hence of little consequence. In certain cases, a re-design of the control actuation system (CAS) may be done.

The technique of the present disclosure can also be used on more than two canards (or fins). In some cases, one benefit is increased control power from the same canards, either more roll power when less pitch power is needed (e.g., maintaining roll control at very high altitude), or increased pitch power when less roll power is needed (e.g., when only minor torque is need to maintain roll orientation).

Using command mixing, pitch canards which are normally used only for steering the projectile can also, simultaneously, control the roll of the projectile via the guidance kit. Hence, the roll canards can be reduced in size or eliminated altogether. Pitch canards are generally used in pairs on opposite sides of the projectile (e.g., left and right). In some cases, using nominal pitch and roll commands, command mixing generates left and right canard commands such that the pair of canards simultaneously generates pitching and rolling moments as needed. For example, in one embodiment a required 10 degree pitch command and a 4 degree roll command, can be effected via mixed commands such as 12 degrees for a left canard and 8 degrees for a right canard. The average 10 degrees will produce approximately the same result as the original 10 degree pitch command and the difference of 4 degrees between the left and the right canards will produce approximately the same result as a 4 degree roll command.

In some cases, command mixing is used on V-tail aircraft. In a conventional aircraft tail configuration, a rudder provides yaw (horizontal) control and an elevator provides pitch (vertical) control. A combination system provides the same control effect as the conventional control surfaces, but through a more complex control system that actuates the control surfaces in unison. Yaw moves the nose to the left and that motion is produced on an upright V tail by moving a pedal left which deflects a left-hand "ruddervator" down and left and a right-hand "ruddervator" up and left. The opposite produces yaw to the right. Pitch moves the nose up and that motion is produced by moving a control column or a stick back which deflects a left-hand "ruddervator" up and right and a right-hand "ruddervator" up and left. Pitch moves the nose down and that motion is produced by moving a control column or a stick forward which induces the opposite movements.

One embodiment of the present disclosure is a system for pitch and roll command mixing for two degrees of freedom control of a gyroscopically, or the like, stabilized projectile using two or more aerodynamic control fins on a roll stabilized guidance kit.

It is understood that gyroscopically (gyro) stabilized projectiles spin to gain stability in flight. Steering a gyro stabilized projectile is difficult because the roll angle is constantly changing, and control fins effect the continually changing direction. Hence a guidance kit on a gyro stabilized projectile is typically de-spun and the roll is controlled to maintain a desired roll angle. Roll angle is typically controlled via roll fins to orient the pitch fins as desired so as to pitch the projectile to a desired orientation. Typically, two fins are used to a projectile's roll angle and two more fins are used to control the projectile's pitch angle.

One embodiment of the current disclosure mixes the pitch and roll commands (via fin deflections) applied to as few as two fins to simultaneously produce both rolling moment and pitching moment. Some advantages of this method are fewer fins (e.g., two instead of four) resulting in lower complexity, less power draw for actuation, less mass, and lower aerodynamic drag. With the benefits of lower cost, higher reliability, higher performance, lower mass yields higher launch speed, lower aerodynamic drag, which holds speed longer. Both of these benefit an increase range for the projectile. Additionally, the canards (fins forward of the center of gravity) reduce gyroscopic stability; elimination of the roll canards thus also increases gyro stability.

If the system of the present disclosure is applied to more than two fins, greater control power is available for maneuvering due to the combined fin area used and greater total fin area that can be exploited for pitch control when roll control needs are low, or greater roll power when pitch control needs are a lower priority—e.g. at apogee where thin air limits maneuver potential but maintaining roll angle is still desired.

Referring to FIG. 1, one embodiment of a guidance kit on a projectile 10 according to the principles of the present disclosure is shown. More specifically, the figure presumes two canards (1, 2) that are equally sized and shaped. In some cases they are equally located axially from the projectile center of gravity CG. In one embodiment they are located equally yet symmetrically opposite radially.

TABLE 1

| Legend for FIG. 1 | |
|---|---|
| CG | Projectile center of gravity |
| 1 | Denotes canard #1 |
| 2 | Denotes canard #2 |
| $F_1$ | Aerodynamic force on canard #1 |
| $F_2$ | Aerodynamic force on canard #2 |
| f | Function relating aerodynamic force to canard deflection |
| $\delta_1$ | Deflection of canard #1 |
| $\delta_2$ | Deflection of canard #2 |
| $x_C$ | Axial location of canards |
| $r_C$ | Radial location of canards |
| PM | pitching moment about the center of gravity generated by canard aerodynamics, positive nose up |
| RM | rolling moment about the center of gravity generated by canard aerodynamics, positive roll right, clockwise when viewed from behind |
| $\delta_P$ | Pitching command |
| $\delta_R$ | Rolling command |
| a,b | Mixing ratio coefficients |

Canard forces are a function deflection, $F_1=f(\delta_1)$ and $F_2=f(\delta_2)$. Then the pitching and rolling moments generated are $$PM=x_c\cdot(F_1+F_2),\text{pitching moment}$$

$$RM=r_c\cdot(F_1-F_2),\text{rolling moment}$$

Guidance commands, $\delta_P$ for pitching and $\delta_R$ for rolling are mixed, e.g. as $$\delta_1=\delta_P+\delta_R,\text{ for canard \#1}$$

$$\delta_2=\delta_P-\delta_R,\text{ for canard \#2}$$

The mixing ratios could be altered if desired using non-unity coefficients, e.g.

$$\delta_1=a\cdot\delta_P+b\cdot\delta_R,\text{ for canard \#1}$$

$$\delta_2=a\cdot\delta_P-b\cdot\delta_R,\text{ for canard \#2}$$

Figure 2:
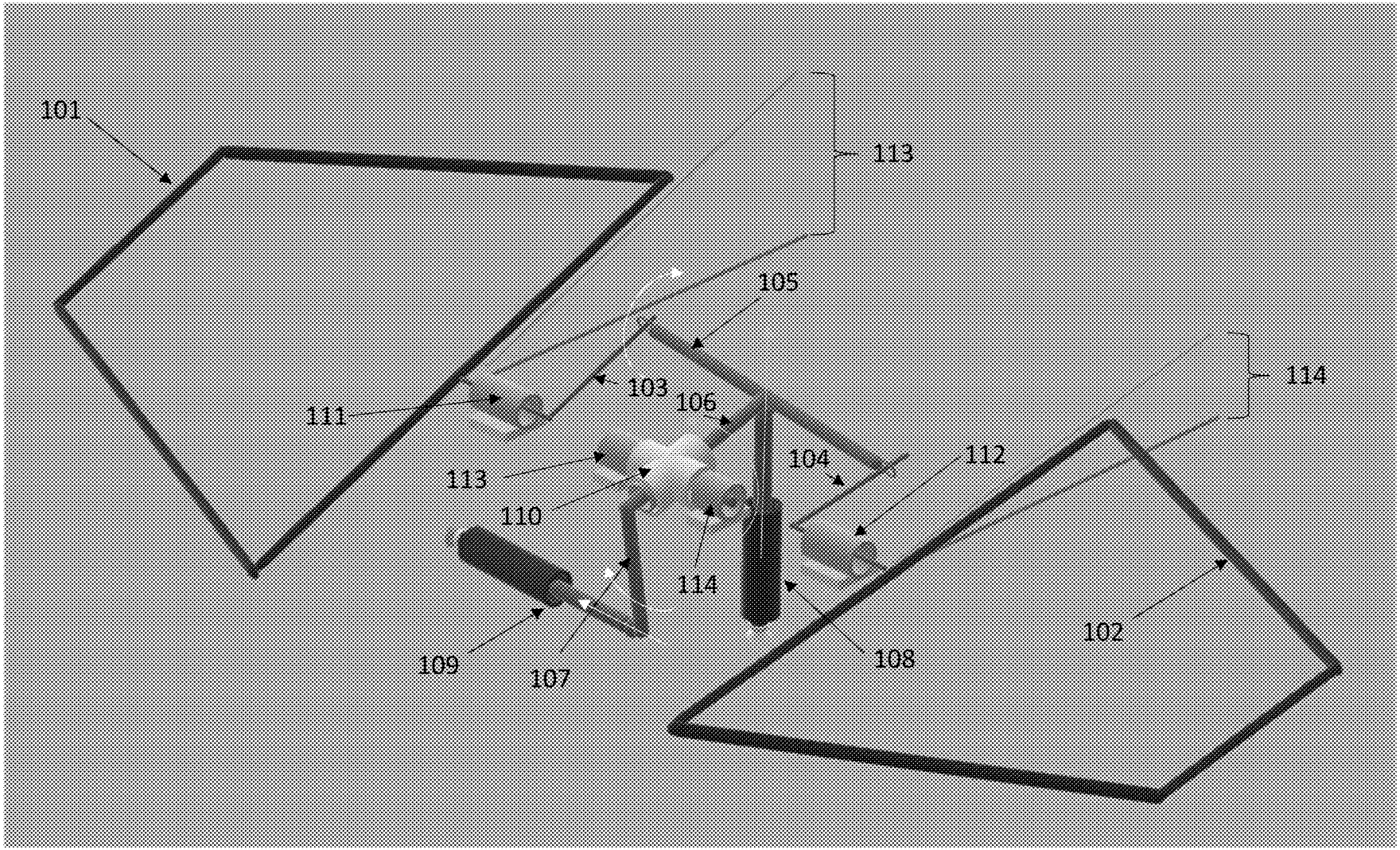
FIG. 2 shows an embodiment of a link shaft for a guidance kit on a projectile according to the principles of the present disclosure.

The mixing in one example is implemented via digital control driving separate pitch and roll actuators, but this is not necessary, as analog or even mechanical means can perform the mixing (See, e.g., FIG. 2).

Figure 3:
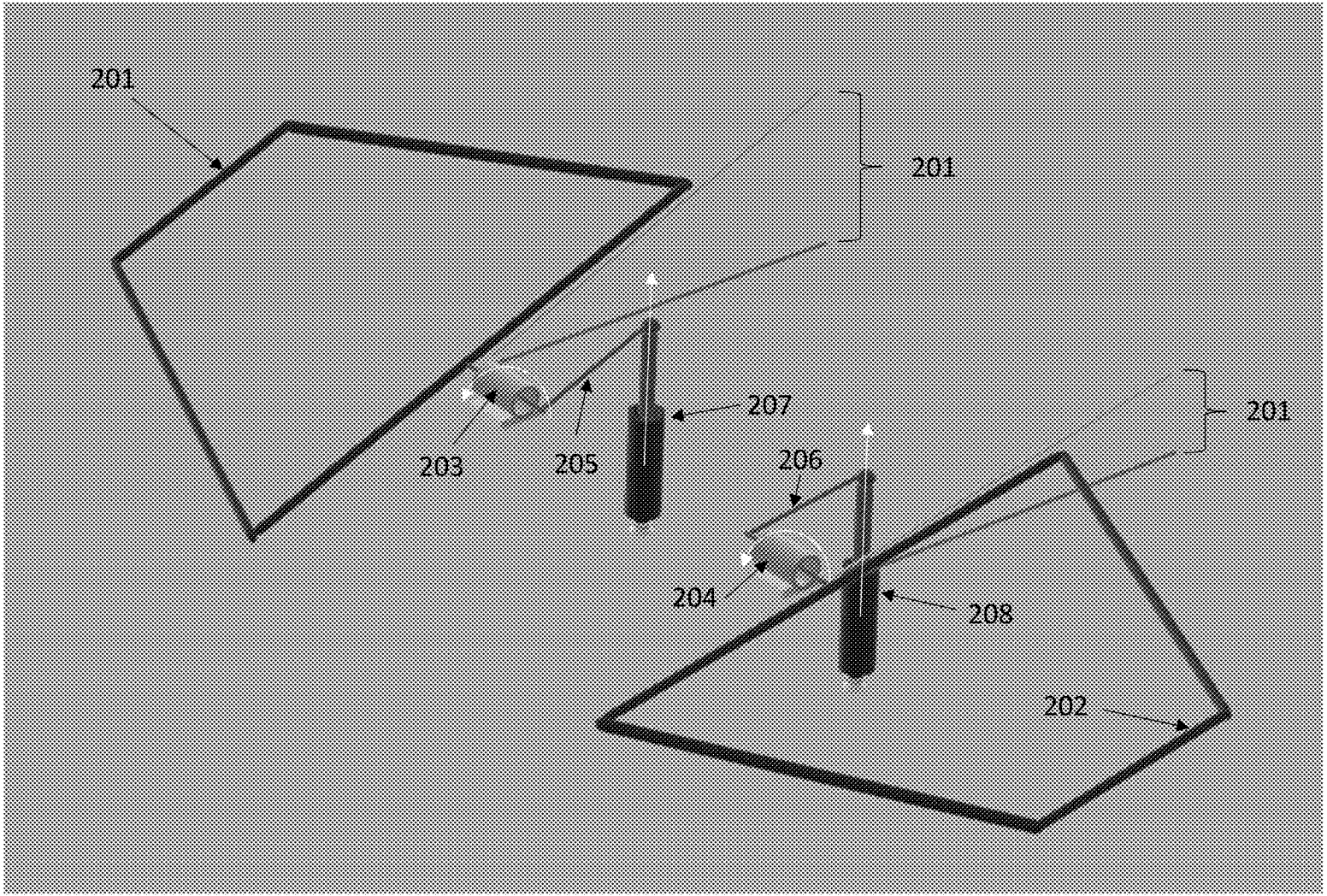
FIG. 3 shows a digital embodiment of a link shaft for a guidance kit on a projectile having according to the principles of the present disclosure.

In certain embodiments, the projectile is operated through or by computer, such as a processor or microprocessor and the fins already are digitally programmed and controlled (See, e.g., FIG. 3). In some cases, the guidance program generates roll and pitch commands for navigation. These commands are then combined to produce the needed rolling and pitching moments. Particularly, in the case of two fins on opposite sides of the guidance kit, one fin can be deflected by the sum of the pitch and roll commands while the other fin can be deflected by the difference of the pitch and roll commands. In this way, the difference of the deflections of the two fins produces a rolling moment. Yet both might also be deflected in the same direction (e.g., both up, but not by the same amount) and this produces a pitching moment.

Referring to FIG. 2, one embodiment of a link shaft for a guidance kit for a projectile according to the principles of the present disclosure is shown. More specifically, the assembly shown performs the command mixing mechanically. In this assembly, the canards (101 and 102) mounted on axles with integral control horns (lever projecting off-axis) (103 and 104) supported by bearings (111 and 112) are joined and driven by a bar 105 rigidly attached to a link shaft 106 which is supported in a gimbal 110 such that the link shaft 106 can both rotate about its own axis within the gimbal and tilt perpendicular to its own axis about the gimbal bearings (113 and 114) mounted to a stationary frame. The tilting raises or lowers the drive bar 105, both ends simultaneously, to deflect both canards in the same direction in response to the extension or retraction of the pitch linear actuator 108 which connects the drive bar to a stationary frame via ball and socket joints at each end. At the same time, a roll linear actuator 109 may drive the link shaft 106 via the rigidly connected extension 107 to rotate about the link shaft axis, thus rotating the drive bar 105 such that its ends (connected to the control horns 103, 104, respectively) move oppositely; one up, the other down, hence driving the canard control horns in opposite directions giving opposite deflection in response to the roll actuator. Hence the canards 101 and 102 may be deflected by differing amounts as indicated by 113 and 114, respectively.

Still referring to FIG. 2, actuator 108, e.g., a linear servo connected to the link shaft 106, extends or retracts per pitch command, $\delta_P$. As it does, it tilts the link shaft 106 raising the drive bar 105 with both ends of the drive bar moving in the same direction. Thus the control horns 103 and 104 turn the canards 101 and 102, respectively, in the same direction. Thus, generating pitching moment. Here, dark grey is used for the actuator extending shaft, black for actuator cylinder, and light grey for the portion of the ball and socket that anchors the actuator to a frame. The ratio of canard deflection to actuator extension is set or fixed and can be altered by the length from the gimbal 110 axis to the actuator connection, 108 to 106.

Actuator 109 is a linear actuator connecting the control lever 107 which is rigidly attached to the end of the link shaft 106 to a stationary frame via ball and socket joints. The link shaft 106 passes through the gimbal 110 such that it can rotate about its own axis. As the actuator 109 extends or retracts per roll command, $\delta_R$, it pushes on the control horn 107 causing it to rotate the link shaft 106 about the link shaft's axis. The rotation of the link shaft (which is rigidly attached to drive bar 105) turns the drive bar 105 perpendicular to the drive bar axis such that one end moves up and the other moves down. Consequently, the drive bar 105 ends connected to the canard control horns 103 and 104 moving in opposite directions causes the canards to deflect in opposite directions. Thus, generating rolling moment. The ratio of canard deflection to actuator extension is set and can be altered by the length from the actuator connection to the link shaft 106 to the link shaft axis.

The gimbal 110 allows the link shaft 106 to simultaneously tilt for pitch control and rotate for roll control. With both motions occurring together, the input pitch command and input roll command mix to produce different deflections 113 and 114 generating the pitching and rolling moments from just two canards.

Referring to FIG. 3, a digital embodiment of a link shaft for a guidance kit on a projectile according to the principles of the present disclosure is shown. More specifically, this embodiment uses digital means to perform the command mixing and thus provides for the mechanism to be simplified considerably. In this mechanism, canards (201 and 202), mounted on axles with integral control horns (205 and 206) supported by bearings (203 and 204) are driven by actuators (207 and 208). The extension or retraction of the actuators push on the control horns, thus rotating the canard axles. The actuators are directed by digitally mixed commands to produce differing canard deflections indicated by (209 and 210), respectively, as desired. In one embodiment, data from a flight control computer is communicated through a cable or other means with driving commands suited to the particular actuator; which might be a digital servo or an analog servo, for example. In either case, it may or may not use an attached travel or position sensor with feedback to the computer or controller as needed depending on the choice of actuator type. Movement for the illustrated actuator is a linear extension of its central driving shaft. Another actuator style could be used instead with suitable alteration of the mechanism, for example rotary servos directly turning the canards about their rotation axes.

Figure 4:
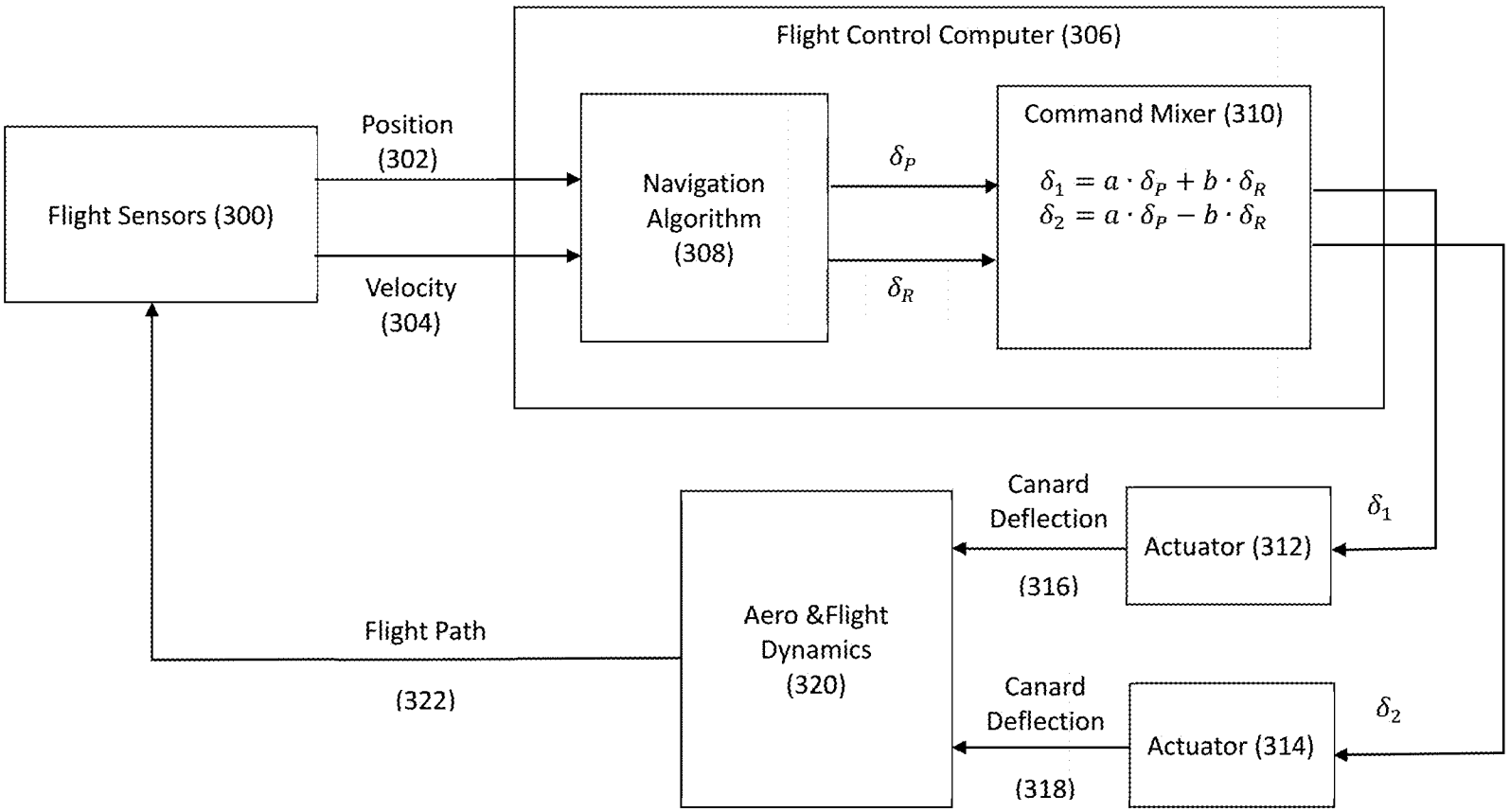
FIG. 4 is a flowchart of one embodiment of a system of using command mixing for a guidance kit on a projectile according to the principles of the present disclosure.

Referring to FIG. 4, a flowchart of one embodiment of a system of using command mixing for a guidance kit on a projectile according to the principles of the present disclosure is shown. More specifically, flight sensors on the projectile 300 feed position 302 and velocity 304 information to a flight control computer, such as a processor or microprocessor 306 running navigation algorithms 308 and a command mixer module 310, as described herein. The flight sensors may include optical imaging, GPS, electro-optical, infrared, as well as accelerometer, gyroscopes and inertial measurement sensors. In one example, the projectile information such as position and velocity are used in conjunction with target information to determine the guidance parameters so that the projectile will achieve the target destination. A navigation algorithm provides the command mixing module with pitch and roll commands ($\delta_P$, $\delta_R$) which are then output as canard commands ($\delta_1$, $\delta_2$) for a first and second actuator (312, 314) to produces canard deflections (316, 318). These deflections are then assessed using aero and flight dynamics to maintain and/or modify the flight path 322 of the projectile. Flight sensors 300 again ascertain the position 302 and velocity 304 of the projectile and the process continues.

The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A system for command mixing of a controlled guidance kit for a projectile, comprising:

a first and a second canard, wherein each canard is connected to a respective first and second control horn;

the first and second control horns being located on opposite ends of a drive bar;

a link shaft being connected via a first end to the drive bar and via a second end to a gimbal; and a first actuator acting on the gimbal via a third control horn and a second actuator acting on the drive bar;

as the first actuator extends or retracts, the link shaft tilts to raise the drive bar with both ends of the drive bar moving in the same direction so the first and second control horns turn the first and second canards, respectively, in the same direction to generate an aerodynamic pitching moment;

as the second actuator extends or retracts per a roll command it pushes or pulls on the end of the third control horn causing it to rotate the link shaft, consequently the link shaft rotation turns the drive bar perpendicular to a drive bar axis such that one end moves up and the other moves down, such that the drive bar ends connected to the first and second control horns move in opposite directions causing the first and second canards to deflect in opposite directions to generate an aerodynamic rolling moment.

2. The system for mechanical command mixing according to claim 1, wherein a ratio of canard deflection to a first actuator extension is set and can be altered by a length from a gimbal axis to an actuator connection.

3. The system for mechanical command mixing according to claim 1, wherein a ratio of canard deflection to a second actuator extension is set and can be altered by a length from an actuator connection to the link shaft to the link shaft axis.

4. The system for mechanical command mixing according to claim 1, wherein the gimbal allows the link shaft to simultaneously tilt for pitch control and rotate for roll control.

5. The system for mechanical command mixing according to claim 1, wherein given pitch and roll commands, deflections of the first and the second canards are generated which produce pitch and roll moments where addition of pitch and roll commands determines deflection commands to be sent to the first canard and subtraction of pitch and roll commands determines deflection commands to be sent to the second canard.

6. The system for mechanical command mixing according to claim 1, wherein a mixing ratio is varied to accommodate or compensate for different pitch and roll responses.

7. The system for mechanical command mixing according to claim 1, wherein the projectile is gyroscopically stabilized.

8. The system for mechanical command mixing according to claim 1, wherein the first actuator or second actuator is a digital servo or an analog servo.

9. The system for mechanical command mixing according to claim 8, wherein the first actuator or second actuator is a linear servo.

* * * * *